US006645310B2

(12) United States Patent
Rinne

(10) Patent No.: US 6,645,310 B2
(45) Date of Patent: Nov. 11, 2003

(54) METHOD FOR CLEANING INDUSTRIAL PIPE SYSTEMS

(75) Inventor: Kari Rinne, Helsinki (FI)

(73) Assignee: Taifun Engineering Oy Ltd., Helsinki (FI)

( * ) Notice: Subject to any disclaimer, the term of this patent is extended or adjusted under 35 U.S.C. 154(b) by 0 days.

(21) Appl. No.: 10/256,005

(22) Filed: Sep. 27, 2002

(65) Prior Publication Data

US 2003/0024550 A1 Feb. 6, 2003

Related U.S. Application Data

(62) Division of application No. 09/858,670, filed on May 17, 2001, now Pat. No. 6,502,270, which is a continuation of application No. PCT/FI99/00953, filed on Nov. 17, 1999.

(30) Foreign Application Priority Data

Nov. 18, 1998 (FI) ..... 982495

(51) Int. Cl.[7] ..... B08B 5/04; B08B 9/027; B08B 9/057

(52) U.S. Cl. ..... 134/8; 134/21; 134/22.11; 134/26

(58) Field of Search ..... 134/8, 21, 22.11, 134/26

(56) References Cited

U.S. PATENT DOCUMENTS 4,048,757 A 9/1977 Kubus et al.
4,061,504 A 12/1977 Zall et al.
4,081,930 A 4/1978 Jones
4,343,703 A 8/1982 Riedel
5,993,562 A * 11/1999 Roelofs et al. ..... 134/7

FOREIGN PATENT DOCUMENTS

| | | |
|---|---|---|
| DE | 2 163 307 | 7/1972 |
| DE | 41 19 947 | 12/1992 |
| EP | 0 030 011 | 6/1981 |
| EP | 0 634 229 | 1/1995 |
| FI | 47722 | 3/1974 |
| FI | 944056 | 9/1994 |
| FI | 950881 | 2/1995 |
| GB | 2323143 | 9/1998 |
| NO | 169823 | 5/1992 |

* cited by examiner

*Primary Examiner*—Zeinab El-Arini
(74) *Attorney, Agent, or Firm*—Young & Thompson

(57) ABSTRACT

A method for cleaning industrial pipe systems, preferably pipe systems used in food industry, such as meat, fish and vegetable industry. The method for cleaning industrial pipe systems, includes the steps of feeding a detergent together with liquid and granules, having a diameter, in batches only into a portion of a pipe, having a cross-section, to be cleaned, whereby one wash batch has a volume in liters, which is 0.05–0.3 times the numerical value of the cross-section in square centimeters of the pipe, creating a negative pressure in the pipe, and bringing the wash batch to flow in the pipe by means of the negative pressure for cleaning and mechanically treating the walls of the pipe.

8 Claims, 3 Drawing Sheets

METHOD FOR CLEANING INDUSTRIAL PIPE SYSTEMS

This application is a divisional of U.S. application Ser. No. 09/858,670 filed May 17, 2001, and now U.S. Pat. No. 6,502,270, based on International application PCT/F199/00953, filed Nov. 17, 1999 which claims priority of Finnish application No. 982495, filed Nov. 18, 1998, the disclosure of which is incorporated herein by reference.

The invention relates to a method for cleaning industrial pipe systems, more precisely to a method for cleaning industrial pipe systems, preferably pipe systems used in food industry, such as meat, fish and vegetable industry, where detergent and liquid are fed into a pipe to be cleaned, and a pressure difference is created in the pipe and the detergent and liquid are brought to flow in the pipe by means of a pressure difference in order to clean the pipe.

DESCRIPTION OF THE RELATED ART

In food industry the pipes transferring foodstuffs have to be cleaned in due time for hygienic reasons in order not to contaminate the foodstuffs transferred therein. A conventional way to clean these pipes is to feed water and detergent through the pipes. The cleaning process also includes cleaning with a disinfectant and rinsing. For example in dairy industry the cleaning agent is often fed in from one end of the pipe to be cleaned using pumps, in which case the flow is maintained until the cleaning agent flows out from the other end of the pipe. The required power of the pump has to be high, since the length of the pipe can extend up to hundreds of meters and the flow rate is, for example, 2–4 m/s. As the diameter of the pump is large, considerable amounts of cleaning agent and disinfectant have to be fed. Owing to the above, cleaning a pipe becomes very expensive.

The cleaning agent, disinfectant and rinsing agent (typically water) can be brought to flow using negative pressure as an alternative for using a pump, which is the conventional means for causing the flows. This is known from slaughtering lines. However, known systems utilizing negative pressure have not been able to provide a desired and an adequate cleaning result.

Known apparatuses for cleaning industrial pipe systems are arranged to transfer, depending on the work phase, washing agent, disinfectant or rinsing agent into the pipe along the entire length of the pipe. The water amounts used are generally large and the actual cleaning phase includes several feedings of the substances, as the inner surface of the pipe is rarely adequately cleaned during one treatment. On account of the above, known apparatuses do not enable the pipe systems to be cleaned rapidly and inexpensively.

BRIEF DESCRIPTION OF THE INVENTION

It is an object of the invention to provide a method removing said drawbacks.

In order to achieve this the present invention provides a method for cleaning industrial pipe systems, having pipe walls, by mechanically treating the walls thereof, said method comprising feeding a detergent together with liquid and granules, having a diameter, in batches only into of a pipe of the pipe system to be cleaned, the pipe having a cross-section, whereby one wash batch has a volume in liters, which is 0.05–0.3 times the numerical value of the cross-section in square centimeters of the pipe;

creating a negative pressure in the pipe; and bringing the wash batch to flow in the pipe by means of the negative pressure for cleaning and mechanically treating the walls of the pipe.

Preferred embodiments of the method of the invention are disclosed below.

One of the greatest advantages of the method of the invention is that it allows industrial pipe systems having a large diameter in particular to be cleaned considerably more economically and more appropriately than previously.

BRIEF DESCRIPTION OF THE DRAWINGS

In the following the invention will be described by means of a preferred embodiment with reference to the attached drawing, in which.

DETAILED DESCRIPTION OF THE INVENTION

Figure 1:
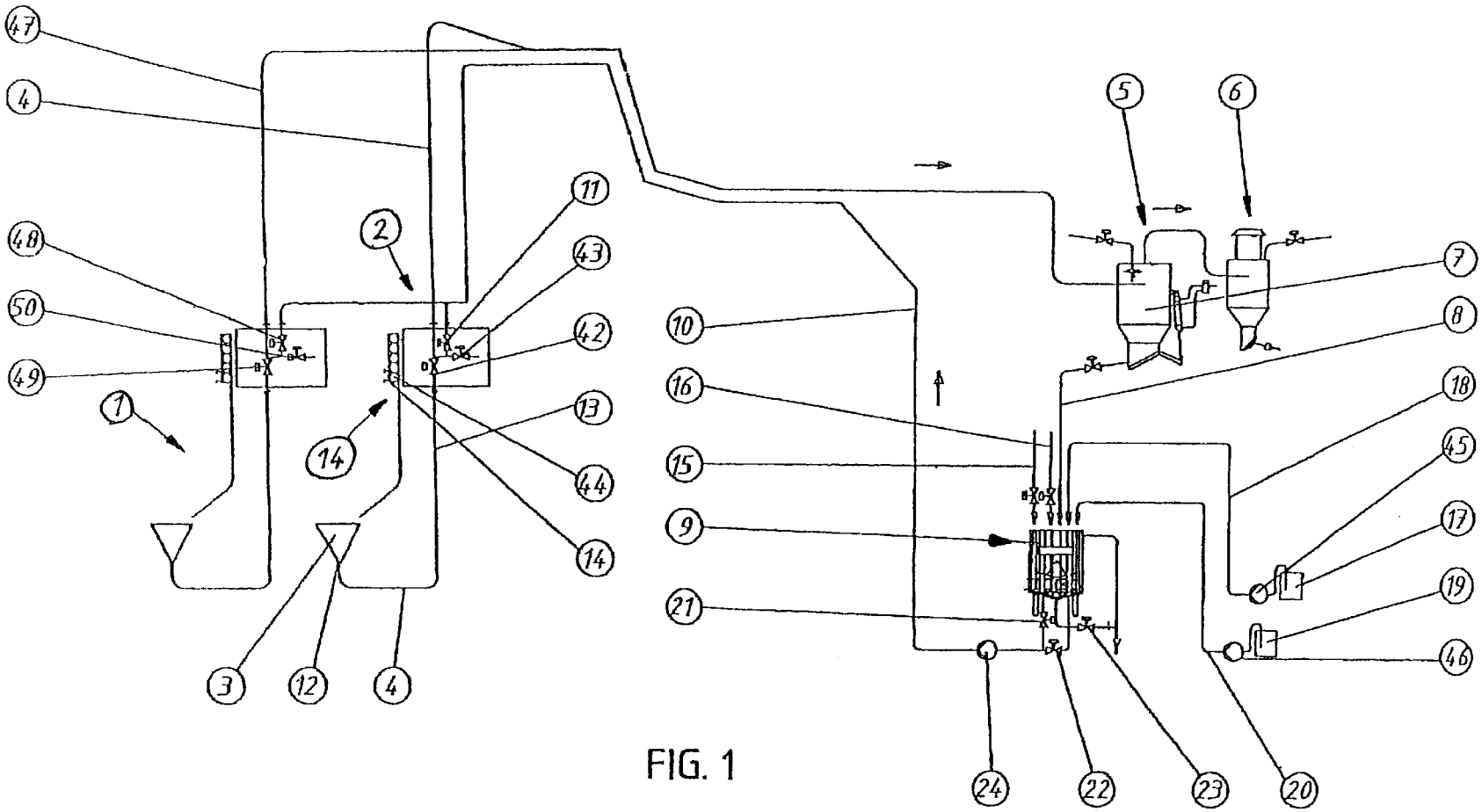
FIG. 1 shows an apparatus of the invention

FIG. 1 shows a poultry slaughtering line comprising a conveyor (not shown in the Figure) for conveying a slaughter animal, like a chicken or the like, to a work station 1. Typically there are several work stations 1, 2 but for the sake of simplicity FIG. 1 only shows two work stations.

The work station 1 comprises a funnel 3, from where a process pipe 4 leads to a separating unit 5. A low pressure unit 6 is connected to the separating unit 5 for creating negative pressure to the separating unit. The separating unit 5 comprises a container 7 which can be opened and closed from above. A pipe 8 leads from the bottom of the container 7 to a washing center 9. The washing center 9 is by means of a feeding pipe 10 connected to the process pipe 4, the connection point being positioned relatively close to the funnel 3. A valve 11 is arranged at that end of the feeding pipe 10 which is close to said connection point. Closing the valve 11 prevents the medium from being transferred from the feeding pipe 10 to the process pipe 4 or from the process pipe to the feeding pipe. The valve 11, which can be referred to as a dosage valve, is arranged close to an end 12 of the pipe 4 comprising the funnel in such a manner that between the end and the valve a pipe portion 13 is formed, whose length and volume are small compared to—the total length and total volume of the pipe. The volume of the pipe portion 13, in liters, is 0.5–3 times the numerical value of the cross-section in square centimeters of the pipe 4, and divided by ten, i.e. the volume is 11.25–67.5 liters for a pipe having a 225 square centimeter cross-section (the diameter of the pipe being 169 mm) and the volume is 45–270 1 for a pipe having a2 900 square centimeter cross-section (the diameter of the pipe being 339 mm). Thus the length and volume of the pipe portion 13 form only a fraction, for example 0.1–10%, of the total length and volume of the pipe 4.

The pipe portion 13 comprises, as shown in FIG. 1, a portion that points upwards. On this account the pipe portion 13 can be filled with the batches described below that form a "water lock" to the pipe 4. Alternatively the pipe portion 13 may include a valve (not shown) that enables the pipe portion 13 to be filled with a batch forming the "water lock".

Reference numeral 14 indicates a wash ball feeding apparatus, which will be described below.

Two water feeding lines 15, 16 lead to the washing center 9 for adding pure water from above to a container 25 of the washing center.

Reference numeral 17 indicates a detergent container that is arranged to feed detergent through a pipe 18 to the washing center container 25 from above.

Reference numeral 19 indicates a disinfection container arranged to feed detergent through a pipe 20 to the washing center container 25 from above.

The end of the feeding pipe 10 on the side of the washing center comprises three valves, what are known as a granulate valve 21, a washing water valve 22 and a dewatering valve 23, the function of which will be described below.

A pump 24 is arranged to the feeding pipe 10 for transferring medium from the washing center to the pipe portion 13.

Figure 2:
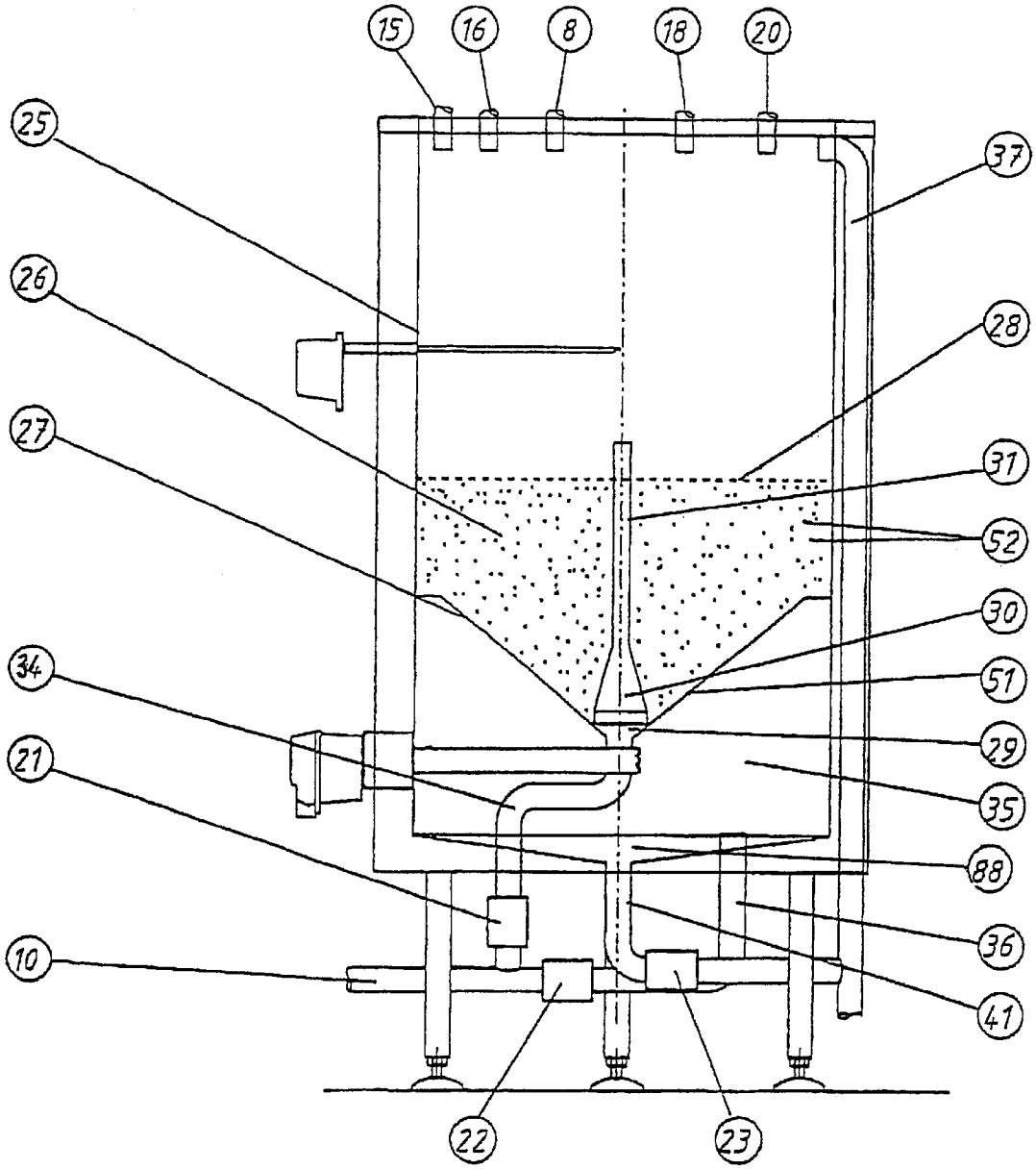
FIG. 2 shows an important part of the apparatus in FIG. 1.
Figure 3:
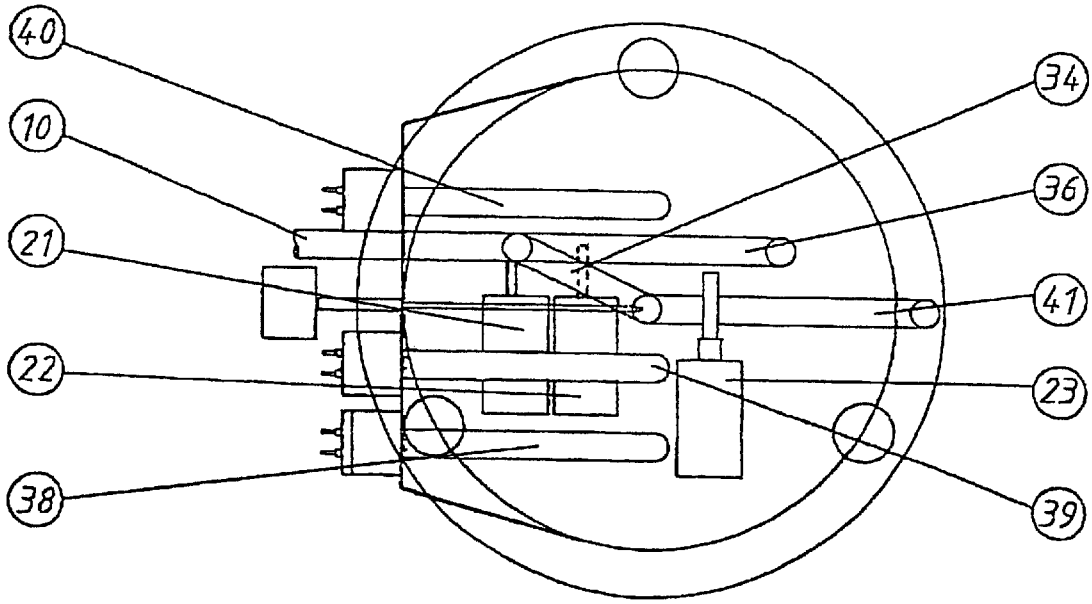
FIG. 3 is a top view along the line III—III illustrating a part of FIG. 2.

FIGS. 2 and 3 show in greater detail the essential components of the washing center in the apparatus.

The washing center container 25 comprises a space, what is known as a granule space 26, for plastic granules 52 which are 1–10 mm in diameter. The diameter of the granules is preferably within 1–3 mm. The plastic granules are supported from below by a tapering feeding plate 27 defining the granule space as conical. A dashed line 28 indicates the upper granule level. The feeding plate 27 is perforated and comprises holes 51 which are smaller than the diameter of the granules to be used. The diameter of the holes 51 is preferably about 1 mm. The plastic granules are worn in use, so that before long the diameter thereof goes below 1 mm, whereafter these small, worn granules fall through the holes of the feeding plate 27 to a sediment space 88 at the bottom of the container where sediment is collected. The sediment is removed along a pipe 41 to a drain by opening the flap valve 23. The lower end of the granule space 26 comprises a delivery outlet 29 that can be closed and opened in the upright direction using an adjusting cone 30 which can be transferred by means of a support rod 31 or another valve element. The adjusting cone 30 is placed at a distance from the delivery outlet 29 so that an appropriate ring-surface is obtained for feeding granules 52. The adjusting cone 30 is perforated, thus allowing the liquid to be transferred through the holes.

The granule space 26 is connected to a feeding pipe 10 through a pipe 34, whereto the valve 21 (granulate valve) is connected.

Beneath the granule space 26 there is a liquid for water. The liquid space 35 is connected to feeding pipe 10 through a pipe 36, whereto the valve 22 (washing water valve) is connected. The upper end of the pipe 36 is above the sediment space 88. Reference number 37 indicates an overflow pipe that leads to the drain.

Heating elements 38–40 are placed inside the container 25 in order to keep the water in a liquid space 35 at a desired temperature.

The material and the liquids are fed into the upper end of the container 25 through said pipes 8, 15, 16, 18 and 20.

The operation of the apparatus is described in the following.

The process is initiated because the process pipe 4 is dirty and should be washed. The process pipe 4 has become dirty since it has been used to transfer slaughtering material to the separating unit 5. The slaughtering material is removed through a lid at the bottom of the separating unit 5.

When the pipe 4 is cleaned after use, the following steps are performed:

A: Pre-wash or first rinse of the pipe,

B: Wash of the pipe,

C: Final wash of the pipe,

D: Intermediate rinse of the pipe,

E: Disinfection of the pipe and

F: Final rinse of the pipe.

During the pre-wash of the pipe, the valve 22 in the washing center 9 is opened and water at a temperature within 30–50° C. is fed from the water space 35 in the washing center into the feeding pipe 10. A particularly appropriate temperature is about 37° C. The temperature is selected so that it will not exceed the limit where the proteins in the pipe 4 "burn" to the pipe. The amount of water to be fed is small compared to the volume of the pipe 4. This water amount is fed using the pump 24 when the valves 11 and 42 are open and when a valve 43, what is known as the air valve, is closed at the pipe portion 13 of the pipe 4. A ball 44 of flexible material, whose inner diameter substantially corresponds to the one of the pipe 4, or another 5' kind of piece is fed from the wash ball feeding apparatus 14 to the funnel 3 and further to the pipe portion. The water in the pipe portion 13 and the ball form a pre-wash batch. The length and volume of the pipe portion 13 are small compared to the length and volume of the pipe 4. The length of the pipe portion 13 is preferably selected so that the pre-wash batch fills the pipe portion. The volume of the pre-wash batch is preferably 20–40 1, when the inner diameter of the pipe 4 is 150 mm, but may in a wider sense be for example 0.1–10% of the volume of the pipe 4.

After this the valves 11 and 43 are closed. The low pressure unit 6 is switched on, whereafter the pressure difference between the end 12 of the pipe comprising the funnel and the end of the pipe comprising the separating unit 5 is 0.2–0.5 bar that brings the pre-wash batch to flow in batches in the pipe 4 to the separating unit 5, and cleans the pipe walls from coarse, or large, loose material, which may fall out through the lid at the bottom of the separating unit. When the batch moves the ball 44 functions as a scraping device. Water is fed into the washing center container 25 when the pipe is being washed. Detergent is also fed into the container 25 using a pump 45. The granule space 26 comprises granules. The water in the liquid space 35 is heated to a temperature that ranges from 50 to 100° C. (the temperature thus remaining beneath the boiling point of water). Water is fed into the feeding pipe 10 through the pipe 36 and the valve 22. Granules are fed into the feeding pipe 10 through the pipe 34 and the valve 21. The amount of water, detergent and granules to be fed is small compared to the volume of the pipe 4. Water, detergent and granules are fed in batches by means of the pipe 24 when the valves 11 and 42 are open and when the valve 43, what is known as the air valve, is closed to the pipe portion 13 of the pipe 4. The water, detergent and the granules in the pipe portion 13 form a wash batch. The volume of the wash batch is, for example, 0.1–10% of the volume of the pipe 4. An adequate washing result is obtained when the percentage of the granules is 30 to 70% by volume of the wash batch volume.

After this, the valves 11 and 43 are closed. The low pressure unit 6 is switched on, whereafter a pressure difference of 0.2 to 0.5 bar is formed across pipe 4, and the wash batch flows in the pipe 4 as a batch to the separating unit 5 on account of the pressure difference and cleans the inner pipe walls. The water, detergent and granules in the wash batch are conveyed along the pipe 8 back to the granule space 26.

Before washing takes place the valve 42 is closed and the valve 43 is opened so that the wash batch can be transferred to the separator 5 using negative pressure during the wash. The work stations 1, 2 may have a mutual air valve 43 that can be referred to as a line rinsing valve.

The wash described above is repeated 1 to 5 times if necessary.

During the final wash of the pipe 4, water at a temperature within 30–70° C. and a wash ball are fed into the pipe portion 13. The final wash batch formed thereof having a small volume is fed into the pipe 4 as described above, whereafter water is emptied from the container 25.

During the intermediate rinse of the pipe 4, water is fed into the container 25 of the washing center. The water in the liquid space 35 is heated to a temperature within 30–50° C. Water is fed in batches into the feeding pipe 10 and to the pipe portion 13 using a pump. An intermediate rinse water batch, the volume of which is small compared to the total length of the pipe 4, is then fed along the pipe 4 into the separating unit 5.

When the pipe 4 is being disinfected, water is fed into the washing center container 25. A disinfectant is also fed into the container 25 using a pump 46. When the disinfectant is fed into the container 25 from above through the pipe 20, the disinfectant cleans the granules in the granule space 26. The water in the liquid space 35 is heated to a temperature within 50–70° C., preferably 60° C. Water is fed into the feeding pipe 10. The amount of water and disinfectant to be fed is small compared to the volume of the pipe 4. The water and the disinfectant are fed into the pipe portion 13. Together the water and disinfectant in the pipe portion 13 form a disinfectant batch. The volume of the disinfectant batch is, for example 0.1–10% of the volume of the pipe 4.

The disinfectant batch is transferred in batches in the pipe 4 to the separating unit 5.

The disinfection described above is repeated 1–5 times if necessary.

The final rinse of the pipe 4 is conducted in the same way as 15 the intermediate rinse, whereby the rinse batch can be referred to as the final rinse water batch.

Said batches are transferred in the pipe at a velocity of 10 to 40 m/s, whereby an optimal result is achieved during cleaning.

The washing center 9 functions as a source to the batches cleaning the pipe.

The pipe 47, 4 connected to the work station 1 is cleaned in the same way as the pipe 4 connected to the work station 2. The pipes can be cleaned at the same time or at different times by appropriately controlling the valves 11, 42, 43, 48–50.

The structure of the washing center 9 can, for example, be different and instead of the valves 11, 42, 43 another valve arrangement can be used for filling the pipe portion 13 with a wash batch and with other batches associated with the method. The plastic granule volume of the batch volume may remain outside the ranges presented. Granules made of other materials may also be used instead of plastic granules. The liquid used for cleaning can be water that contains various chemicals. The method is still economical if a liquid that is significantly more expensive than water is used, since the volume of the wash batches and cleaning batches remains small even if the diameters of the pipes to be cleaned are large (for example over 100 mm). The detergent may be any detergent generally used in the field and any alkaline or acid liquid may function as the detergent. During cleaning the pressure to be used does not have to create a pressure difference of 0.2 to 0.5 bar to the pipe 4, although such a pressure difference has proved to be very effective (since it does not cause any blockages in the pipe to be cleaned) at a wider scale the pressure difference may range from 0.1 to 0.97 bar. Water heated up to a 100° C. temperature can be used for the final wash, intermediate rinse, disinfection and final rinse of the pipe. The method can basically be applied for cleaning any pipe systems, such as cleaning the pipe systems conveying food debris or concrete.

The invention has above been described by means of one example only and it is therefore pointed out that the invention can be implemented in various ways deviating from the example described above within the scope of the attached claims.

I claim:

1. A method for cleaning industrial pipe systems, having pipe walls, by mechanically treating the walls thereof, said method comprising:

feeding a detergent together with liquid and granules, having a diameter, in batches only into a pipe of the pipe system to be cleaned, the pipe having pipe walls and a cross-section, wherein one wash batch has a volume in liters, which is 0.05–0.3 times a numerical value of the cross-section in square centimeters of the pipe;

creating a negative pressure in the pipe; and a washing step of bringing the wash batch to flow in the pipe by means of the negative pressure for cleaning and mechanically treating the walls of the pipe.

2. A method as claimed in claim 1, wherein plastic granules having a diameter of 1 to 3 mm are used as granules.

3. A method as claimed in claim 1, wherein the granules form 30 to 70% by volume of the wash batch volume.

4. A method as claimed in claim 1, further comprising, prior to said washing step, a step of prewashing the pipe to be cleaned with a pre-wash batch, the pre-wash batch comprising a liquid containing water at a temperature within 30–50° C. and an elastic body substantially corresponding to an inner diameter of the pipe to be cleaned, said pre-wash batch being dispensed into a portion of the pipe to be cleaned, whereafter the pre-wash batch is transferred by means of a negative pressure along the pipe to be cleaned in order to clean the walls of the pipe from loose material.

5. A method as claimed in claim 4, wherein at least two wash batches are brought to flow in the pipe to be cleaned, whereafter the pipe to be cleaned is rinsed with a rinse batch in a rinse step comprising feeding liquid comprising water at a temperature within 30–50° C. into a portion of the pipe to be cleaned, and thereafter transferring the rinse batch by means of negative pressure along the pipe to be cleaned.

6. A method as claimed in claim 5, wherein after the rinse step the pipe to be cleaned is disinfected in at least one disinfection step, and then rinsed in a final rinse step, and during the disinfection step a disinfectant and water at a temperature within 59–70° C. are dispensed as a disinfection batch into a portion of the pipe to be cleaned, whereafter the disinfection batch is brought to flow along the pipe to be cleaned by means of negative pressure for disinfecting the walls of the pipe to be cleaned and in the final rinse step final rinse water at a temperature within 30–50° C. is dispensed as a final rinse batch into a portion of the pipe to be cleaned, and thereafter the final rinse batch is brought to flow along the pipe to be cleaned by means of negative pressure for a final rinse of the pipe to be cleaned.

7. A method as claimed in claim 1, further comprising, prior to said washing step, a step of prewashing the pipe to be cleaned with a pre-wash batch, the pre-wash batch comprising a liquid containing water at a temperature within 50–100° C. and an elastic body substantially corresponding to an inner diameter of the pipe to be cleaned, said pre-wash batch being dispensed into a portion of the pipe to be cleaned, whereafter the pre-wash batch is transferred by means of a negative pressure along the pipe to be cleaned in order to clean the walls of the pipe from loose material.

8. A method as claimed in claim 1, wherein the negative pressure in the pipe is created by a pressure difference of 0.2 to 0.5 bar.

* * * * *